US007195129B2

(12) United States Patent
Klemm

(10) Patent No.: US 7,195,129 B2
(45) Date of Patent: Mar. 27, 2007

(54) INNER CONTAINER FOR HOUSEHOLD DEVICES

(75) Inventor: Klaus Klemm, Oberelsbach (DE)

(73) Assignee: Basell Polyolefine GmbH, Wesseling (DE)

( * ) Notice: Subject to any disclaimer, the term of this patent is extended or adjusted under 35 U.S.C. 154(b) by 179 days.

(21) Appl. No.: 09/782,304

(22) Filed: Feb. 14, 2001

(65) Prior Publication Data

US 2001/0017301 A1 Aug. 30, 2001

(30) Foreign Application Priority Data

Feb. 18, 2000 (DE) ..... 100 07 502

(51) Int. Cl.

| | |
|---|---|
| ***B65D 1/40*** | (2006.01) |
| ***B65D 3/22*** | (2006.01) |
| ***B65D 6/14*** | (2006.01) |
| ***D06F 29/00*** | (2006.01) |

(52) U.S. Cl. ..... 220/62.15; 220/62.22; 68/23.2

(58) Field of Classification Search ..... 220/592.23, 220/592.25, 62.15, 62.22, 4.05, 4.06; 222/131
See application file for complete search history.

(56) References Cited

U.S. PATENT DOCUMENTS

| | | | | |
|---|---|---|---|---|
| 3,681,820 | A * | 8/1972 | Jalbert | 27/7 |
| 3,752,351 | A * | 8/1973 | Nagata | 215/12.2 |
| 3,910,449 | A * | 10/1975 | Gezari | 220/62.22 |
| 4,224,265 | A * | 9/1980 | Pfisterer | 264/71 |
| 4,408,420 | A * | 10/1983 | Haase | 52/1 |
| 4,465,020 | A * | 8/1984 | Schafer | 119/73 |
| 4,632,796 | A * | 12/1986 | Moulet | 264/251 |
| 4,793,491 | A * | 12/1988 | Wolf et al. | 206/509 |
| 5,321,873 | A * | 6/1994 | Goria | 264/256 |
| 5,373,715 | A * | 12/1994 | Sharp et al. | 68/23 R |
| 5,419,164 | A * | 5/1995 | Durazzani | 68/23.2 |
| 5,611,125 | A * | 3/1997 | Williams et al. | 27/14 |
| 5,983,585 | A * | 11/1999 | Spakousky | 52/405.1 |
| 5,983,962 | A * | 11/1999 | Gerardot | 141/231 |
| 6,167,671 | B1 * | 1/2001 | Wilson | 52/293.3 |
| 6,282,763 | B1 * | 9/2001 | Goria | 264/256 |
| 6,453,626 | B1 * | 9/2002 | Weilein et al. | 52/139 |

FOREIGN PATENT DOCUMENTS

| | | |
|---|---|---|
| DE | 196 04370 | 6/1997 |
| DE | 197 22339 | 12/1998 |
| DE | 198 58173 | 6/2000 |
| GB | A 1 033 280 | 6/1966 |
| GB | A 2 272 913 | 6/1994 |
| GB | 2285 404 | 8/1995 |

* cited by examiner

*Primary Examiner*—Nathan J. Newhouse
*Assistant Examiner*—Harry A. Grosso
(74) *Attorney, Agent, or Firm*—Novak Druce & Quigg LLP

(57) ABSTRACT

Inner containers for household devices in the form of a drum composed of an inner and an outer wall with a shear-resistant connection between the two walls, where both the inner and outer walls have been built up from a thermoplastic. The design of the novel inner container may also be such that the cavity between the inner and outer walls is filled with a filler. A particular thermoplastic used is polypropylene.

18 Claims, 4 Drawing Sheets

INNER CONTAINER FOR HOUSEHOLD DEVICES

The present invention relates to inner containers for household devices in the form of a drum composed of an inner and an outer wall with a shear-resistant connection between the two walls, where both the inner and outer walls have been built up from a thermoplastic.

The present invention further relates to a process for producing an inner container of this type and to its use as an inner drum for front- or top-loading washing machines, or for laundry dryers.

BACKGROUND OF THE INVENTION

Thermoplastics have been used for some time as constituents of household devices. The thermoplastics here are frequently used as worktops or as functional parts or housing parts.

For example, DE-A 19604370 discloses worktops made from thermoplastics comprising a sheet of plastic, to the underside of which has been applied a support apparatus composed of a grid-like component with an open lower side.

DE-A 1 97 22 339 discloses a layered composite material which comprises a support layer made from polypropylene, a decorative layer arranged thereupon, and a heat-cured layer applied to the decorative layer, DE-A 19 858 173 moreover describes a layered composite material made from a support layer of various other thermoplastic polymers, for example made from certain copolymers of styrene or from polyoxymethylene or, respectively, from polybutylene terephthalate, together with a decorative layer applied thereto and a heat-cured layer located on the decorative layer. Compared with conventional layered composite materials with support layers made from wood, from wood fibers or from paper, layered composite materials of this type made from a support layer made from thermoplastic polymers have, inter alia, high temperature resistance and high moisture resistance, and better mechanical strength, and are easier to process.

It is also known that drum-shaped inner containers of household devices can be produced from thermoplastic polymers, mostly from reinforced polypropylene. Inner containers of this type are composed of only one wall, which for reasons of strength has ribs or offset walling elements. A disadvantage of these structures is that this design sometimes requires expensive plastics and/or high wall thicknesses in order to accept the loadings which arise. There are even some desirable versions of devices (with very high spin speeds) which cannot be produced industrially by the lower-cost method of production using plastics. A disadvantage of high wall thicknesses is the need to accept very long solidification times in injection molding, as well as high materials consumption, and this also increases the cost of producing the parts. The reason for this lies in the way the components have to be designed. An important criterion for an inner container is the stiffness of its wall to which the bearing is introduced or applied. In simple terms, the washing and spinning procedures of the household device, for example of the washing machine, together with the unbalanced mass (laundry) in the inner drum, subject the rear wall of the device to a variable flexural load resulting from the tumbling action of the inner drum in the holding vessel. However, this tumbling is permissible only to the extent that the inner drum does not touch the holding vessel. This consideration also applies to the inner drum in washing or drying devices which are currently still produced from sheet steel with reinforcement by diecast metal. Here, too, the stiffness of the shaped part, in particular the stiffness of the drum axle and of the rear wall of the drum are necessary in order to dissipate the force exerted by the unbalanced mass, while not generating excessive deformation.

Drum-shaped inner containers produced from thermoplastics and used in household devices have hitherto been suitable only for application sectors with limited mechanical loading. This implies, inter alia, that the spin rotation rate and the unbalanced mass for drum-shaped inner containers of this type should not be too great. The limited load-bearing capability of the drums made from thermoplastics known hitherto has also limited the number of thermoplastic materials which can be used.

It is an object of the present invention, therefore, to remove the disadvantages described and to provide an improved drum-shaped inner container for household devices, made from thermoplastics and capable of operation even at increased spin rotation rates and/or with an increased unbalanced mass. It should be possible to produce the drum-shaped inner container from a very wide variety of thermoplastics, and the drum should moreover also have very low overall depth.

BRIEF SUMMARY OF THE INVENTION

We have found that this object is achieved by developing an improved inner container for household devices, in the form of a drum composed of an inner and an outer wall with a shear-resistant connection between the two walls, where both the inner and outer walls have been built up from a thermoplastic.

DETAILED DESCRIPTION OF THE INVENTION

Figure 1:
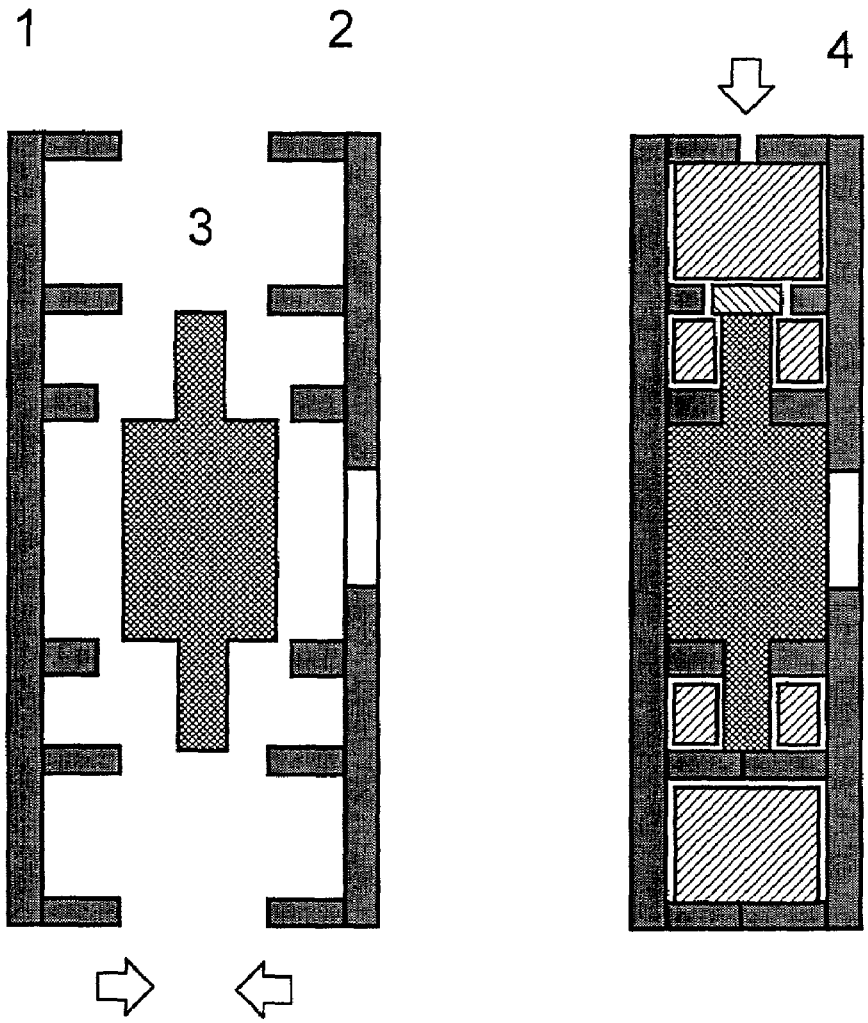
FIG. 1 depicts a diagram of an inner container for a top-loafer washing machine.

In one variant, the novel, drum-shaped inner container may also be in a form which is filled with a filler, in order to increase its mechanical strength and load-bearing capability, in particular when subjected to increased spin rotation rates and an increased unbalanced mass, or else to improve noise performance. The filler here may be solid or liquid.

Examples of suitable fillers are rock flour, concrete, talc, sand, and also liquids, gels or foamed plastics, such as polyurethane foams, in particular flexible foams made from polyurethane.

The inner wall of the novel drum-shaped inner container has a wall thickness of from 0.5 to 20 mm, in particular from 2 to 5 mm, and the thickness of the outer wall is from 0.5 to 20 mm, in particular from 2 to 5 mm. The cavity situated between the inner wall and the outer wall has a thickness of from 1 to 300 mm, in particular from 20 to 150 mm. For the purposes of the present invention, an inner container here is either the holding vessel (tub) or else the corresponding inner drum.

The thermoplastic from which the inner and outer walls of the novel drum-shaped inner container are composed may comprise from 1 to 60% by weight, preferably from 5 to 50% by weight, particularly preferably from 10 to 40% by weight, based on the total weight of the thermoplastic, of reinforcing fillers, such as barium sulfate, magnesium hydroxide, talc with an average particle size of from 0.1 to 10 μm, measured to DIN 66 115, wood, flax, chalk, glass fibers, coated glass fibers, long or short glass fibers, glass beads or mixtures of these. The usual additives may also be added to the thermoplastic, for example light stabilizers, UV stabilizers, and heat stabilizers, pigments, carbon blacks, lubricants, flame retardants, blowing agents and the like, in the amounts which are customary and required.

Possible thermoplastic polymers for forming the inner and outer walls of the novel inner container include polypropylene, polyethylene, polyvinyl chloride, polysulfones, polyetherketones, polyesters, polycycloolefins, polyacrylates and polymethacrylates, polyamides, polycarbonate, polyurethanes, polyacetals, such as polyoxymethylene, polybutylene terephthalates and polystyrenes. Either homopolymers or else copolymers of these thermoplastic polymers may be used here. Besides the reinforcing fillers it is preferable to use polypropylene, polyoxymethylene, polybutylene terephthalate or polystyrene, or else in particular copolymers of styrene with subordinate proportions of one or more comonomers, such as butadiene, α-methylstyrene, acrylonitrile, vinylcarbazole, or else esters of acrylic, methacrylic or itaconic acid. It is also possible to use recylcled materials made from these thermoplastic polymers.

For the purposes of the present invention, polyoxymethylene is a homo or copolymer of aldehydes, for example of formaldehyde, or of cyclic acetals, containing recurring carbon-oxygen bonds in the molecule and having a melt flow rate (MFR) to ISO 1133 of from 5 to 40 g/10 min., in particular from 5 to 30 g/10 min., at 230° C. under a load of 2.16 kg.

The polybutylene terephthalate preferably used is a relatively high-molecular-weight esterification product of terephthalic acid with butylene glycol having a melt flow rate (MFR) to ISO 1133 of from 5 to 50 g/10 min., in particular from 5 to 30 g/10 min., at 230° C. under a load of 2.16 kg.

Copolymers of styrene are in particular copolymers having up to 45% by weight, preferably up to 20% by weight, of copolymerized acrylonitrile. These copolymers made from styrene and acrylonitrile (SAN) have a melt flow rate (MFR), to ISO 1133, of from 1 to 25 g/10 min, in particular from 4 to 20 g/10 min, at 230° C. under a load of 2.16 kg.

Preference is also given to the use of copolymers of styrene comprising up to 35% by weight, in particular up to 20% by weight, of copolymerized acrylonitrile and up to 35% by weight, in particular up to 30% by weight, of copolymerized butadiene. The melt flow rate of these copolymers made from styrene, acrylonitrile and butadiene (ABS), to ISO 1133, is from 1 to 40 g/10 min, in particular from 2 to 30 g/10 min, at 230° C. under a load of 2.16 kg.

Other materials particularly used for the inner and outer walls of the novel drum-shaped inner container are polyolefins, such as polyethylene or polypropylene, preferably the latter. For the purposes of the present invention, polypropylene is a homo- or copolymer of propylene. Copolymers of propylene contain subordinate amounts of monomers copolymerizable with propylene, for example $C_2$-$C_8$-1-alkenes, such as ethylene, 1-butene, 1-pentene or 1-hexene. It is also possible to use two or more different comonomers.

Examples of particularly suitable support materials are homopolymers of propylene or copolymers of propylene with up to 50% by weight of other copolymerized 1-alkenes having up to 8 carbon atoms. The copolymers of propylene here are random copolymers or block or impact copolymers. If the copolymers of propylene have a random structure they generally contain up to 15% by weight, preferably up to 6% by weight, of other 1-alkenes having up to 8 carbon atoms, in particular ethylene, 1-butene or a mixture of ethylene and 1-butene.

Block or impact copolymers of propylene are polymers for which the first stage is to prepare a propylene homopolymer or a random copolymer of propylene with up to 15% by weight, preferably up to 6% by weight, of other 1-alkenes have up to 8 carbon atoms and then, in the second stage, polymerize onto this a propylene-ethylene copolymer having an ethylene content of 15 to 80% by weight, where the propylene-ethylene copolymer may also contain other $C_4$-$C_8$-1-alkenes. The amount of the propylene-ethylene copolymer polymerized on here is generally such that in the final product the proportion of the copolymer produced in the second stage is from 3 to 60% by weight.

The polymerization to prepare polypropylene may use a Ziegler-Natta catalyst system. The catalyst systems used here are in particular those which have cocatalysts in the form of organic aluminum compounds b) and electron-donor compounds c), as well as a titanium-containing solid component a).

It is, however, also possible to use catalyst systems based on metallocene compounds and, respectively, based on metal complexes active in polymerization.

Specifically, usual Ziegler-Natta catalyst systems comprise a titanium-containing solid component, inter alia halides or alcoholates of tri- or tetravalent titanium, and also a halogen-containing magnesium compound, inorganic oxides, e.g. silica gel, as supports, and also electron-donor compounds. These are in particular carboxylic acid derivatives, or else ketones, ethers, alcohols or organosilicon compounds.

The titanium-containing solid component may be prepared by methods known per se. Examples of these are given, inter alia, in EP-A 45 975, EP-A 45 977, EP-A 86 473, EP-A 171 200, GB-A 2 111 066, U.S. Pat. No. 4,857,613 and U.S. Pat. No. 5,288,824. The process known from DE-A 195 29 240 is preferably used.

Suitable aluminum compounds b), besides trialkylaluminum compounds, are those compounds in which one alkyl group has been replaced by an alkoxy group or by a halogen atom, for example by chlorine or bromine. The alkyl groups may be identical or differ from one another. The alkyl groups may be linear or branched. Preference is given to the use of trialkylaluminum compounds having alkyl groups each of which has from 1 to 8 carbon atoms, for example trimethylaluminum, triethylaluminum, triisobutylaluminum, trioctylaluminum or methyldiethylaluminum, or mixtures of these.

A further cocatalyst used, besides the aluminum compound b), is generally electron-donor compounds c), such as mono-or polybasic carboxylic acids, carboxylic anhydrides or carboxylic esters, or else ketones, ethers, alcohols or lactones, or else organophosphorus or organosilicon compounds. The electron-donor compounds c) may be identical with or different from the electron-donor compounds used to prepare the titanium-containing solid component a).

Instead of Ziegler-Natta catalyst systems it is also possible to prepare polypropylene by using metallocene compounds and, respectively, metal complexes active in polymerization.

For the purpose of the present invention, metallocenes are complex compounds made from metals of transition groups of the Periodic Table with organic ligands, giving effective catalyst systems when combined with metallocenium-ion-forming compounds. When used to prepare polypropylene, the metallocene complexes in the catalyst system are generally in supported form. Supports frequently used are inorganic oxides, but it is also possible to use organic supports in the form of polymers, such as polyolefins. Preference is given to the inorganic oxides described above, which are also used to prepare the titanium-containing solid component a).

The central atoms in the metallocenes usually used are titanium, zirconium or hafnium, preferably zirconium. The central atom generally has bonding via a $\pi$ to at least one, generally substituted, cyclopentadienyl group, and also to other substituents. The other substituents may be halogens, hydrogen or organic radicals, preferably fluorine, chlorine, bromine or iodine or $C_1$—$C_{10}$-alkyl. The cyclopentadienyl group may also be a constituent of an appropriate heteroaromatic system.

Preferred metallocenes contain central atoms which have bonding via two identical or different $\pi$ bonds to two substituted cyclopentadienyl groups. Particularly preferred metallocenes are those in which there are substituents of the cyclopentadienyl groups bonded to both cyclopentadienyl groups. Particular preference is given to complexes whose substituted or unsubstituted cyclopentadienyl groups additionally have substitution on two adjacent carbon atoms by cyclic groups, where the cyclic groups may also have been integrated within a heteroaromatic system.

Other preferred metallocenes are those which contain only one substituted or unsubstituted cyclopentadienyl group which, however, has substitution by at least one radical also bonded to the central atom.

Examples of suitable metallocene compounds are ethylenebis (indenyl) zirconium dichloride, ethylenebis (tetrahydroindenyl) zirconium dichloride, diphenylmethylene-9-fluorenylcyclopentadienylzirconium dichloride, dimethylsilanediylbis (3-tert-butyl-5-methylcyclopentadienyl)-zirconium dichloride, dimethylsilanediyl (2-methyl-4-azapentalene) (2-methyl-4-(4'-methylphenyl) indenyl) zirconium dichloride, dimethylsilanediyl (2-methyl-4-thiapentalene) (2-ethyl-4-(4'-tert-butylphenyl) indenyl) zirconium dichloride, ethanediyl (2-ethyl-4-azapentalene) (2-ethyl-4-(4'-tert-butylphenyl) indenyl) zirconium dichloride, dimethylsilanediylbis (2-methyl-4-azapentalene) zirconium dichloride, dimethylsilanediylbis (2-methyl-4-thiapentalene) zirconium dichloride, dimethylsilanediylbis (2-methylindenyl) zirconium dichloride, dimethylsilanediylbis (2-methylbenzindenyl) zirconium dichloride, dimethylsilanediylbis (2-methyl-4-phenylindenyl) zirconium dichloride, dimethylsilanediylbis (2-methyl-4-naphthylindenyl) zirconium dichloride, dimethylsilanediylbis (2-methyl-4-isopropylindenyl) zirconium dichloride and dimethylsilanediylbis (2-methyl-4,6-diisopropylindenyl) zirconium dichloride, and also the corresponding dimethylzirconium compounds.

The metallocene compounds are either known or can be obtained by known methods. It is also possible to use mixtures of metallocene compounds of this type for catalysis, or to use the metallocene complexes described in EP-A 416 815.

The metallocene catalyst systems also comprise metallocenium-ion-forming compounds. Those suitable are strong, neutral Lewis acids, ionic compounds with Lewis-acid cations or ionic compounds with Brönsted acids as cation. Examples of these are tris (pentafluorophenyl)borane, tetrakis (pentafluorophenyl)borate and salts of N, N-dimethylanilinium. Other suitable metallocenium-ion-forming compounds are open-chain or cyclic aluminoxane compounds. These are usually prepared by reacting trialkylaluminum compounds with water and are generally mixtures of linear and also cyclic chain molecules of various lengths.

The metallocene catalyst systems may moreover comprise organometallic compounds of the metals of the 1st, 2nd or 3rd main group of the Periodic Table, for example n-butyllithium, n-butyl-n-octylmagnesium or triisobutylaluminum, triethylaluminum or trimethylaluminum.

The polypropylenes used for the inner and outer walls of the novel inner container are prepared by polymerization in at least one reaction zone, or else frequently in two or even more reaction zones arranged in series (a reactor cascade), in the gas phase, in suspension or in a liquid phase (bulk). The usual reactors for polymerizing $C_2$—$C_8$ 1-alkenes may be used. Examples of suitable reactors are continuous stirred-tank reactors, loop reactors and fluidized-bed reactors. The size of the reactors is not significant here. It depends on the output which is to be achieved in the individual reaction zone(s).

Use is in particular made of fluidized-bed reactors or else reactors with horizontally or vertically agitated powder-beds. The reaction bed is generally composed of the polymer made from $C_2$—$C_8$-1-alkenes which is polymerized in the respective reactor.

The polypropylene used as support layers are polymerized under conventional reaction conditions at from 40 to 120° C., in particular from 50 to 100° C., and at pressures of from 10 to 100 bar, in particular from 20 to 50 bar.

The polypropylenes used generally have a melt flow rate (MFR), to ISO 1133, of from 0.1 to 200 g/10 min., in particular from 0.2 to 100 g/10 min., at 230° C. under a load of 2.16 kg.

It is also possible to use blends, i.e., mixtures of different thermoplastics, for example blends made from a copolymer of styrene with acrylonitrile and a copolymer made from butadiene and acrylonitrile.

The structure of the inner and outer walls of the novel, drum-shaped inner container may also be such that, to improve appearance, a laminate made from a decorative layer and from a heat-cured layer situated on the decorative layer has also been applied to the thermoplastic. It can also be advisable for an intermediate layer also to be introduced between the thermoplastic and the decorative layer, preferably made from the thermoplastic used as the material for the inner and outer walls, giving an improvement in adhesion and bonding performance. The intermediate layer is in particular a thin film or else a thin nonwoven with a thickness of from 0.001 to 1.0 mm, in particular from 0.005 to 0.3 mm. Possible materials for the intermediate layer are the same thermoplastic as described above for the inner and outer walls, i.e. in particular polypropylene and polyethylene, polymers of styrene, polyoxymethylene or polybutylene terephthalate.

With the aid of the laminate layer made from the decorative layer and from the heat-cured layer, the novel inner container may be given a certain surface quality (color), for example, better surface hardness and abrasion resistance, or else higher flame retardancy.

Other materials preferred as intermediate layer are resin-saturated nonwovens and resin-saturated thermoplastic films. The resins used for this are in particular acrylate resins, phenolic resins, urea resins or melamine resins. The degree of resinification here may be up to 300%, meaning that practically the entire surface of the intermediate layer has more than one coating of resin. The degree of resinification is preferably from 50 to 150%, in particular from 80 to 120%. The weight of intermediate layer per $m^2$ is from 15 to 150 g, in particular from 30 to 60 g.

The decorative layer may be composed of a plastic which has an embossment or a coloration, or both combined, and this may be in the form of a ready-to-use laminate. However, the decorative layer may also be composed of paper or of a fabric or of a paper-like or fabric-like or wood-like or metal-like material. Examples of these materials would be decorative layers made from an aluminum-type material or from a stainless-steel-type material or else from a leather-, silk-, wood-, cork- or linoleum-type material. The decorative layer may also have been resinified with acrylic resins, phenolic resins, urea resins or melamine resins, with a degree of resinification of from 50 to 300%, in particular from 100 to 300%, based on the weight of the decorative layer. The weight of the decorative layer is usually from 10 to 200 g/$m^2$, in particular from 30 to 150 g/$m^2$ and particularly preferably from 50 to 130 g/$m^2$. The decorative layer may also be composed of a colored plastic.

The heat-cured layer (overlay) arranged on the decorative layer is preferably composed of a thermoset, for example of a paper saturated with acrylic resin, with phenolic resin, with melamine resin or with urea resin and crosslinked by exposure to pressure or heat during the production of the layered composite material. The weight of the heat-cured layer (overlay) is usually from 10 to 300 g/$m^2$, in particular from 15 to 150 g/$m^2$ and particularly preferably from 20 to 70 g/$m^2$.

The heat-cured layer (overlay) may also, if desired, have been arranged as a ready-to-use laminate on the decorative layer, on one or else on both sides. It is also possible to apply to the intermediate layer a ready-to-use laminate which is composed of the decorative layer and of the overlay. Ready-to-use laminates of this type are known per se and are available, inter alia, from Melaplast in Schweinfurt, Germany.

The novel inner containers are obtainable by a process which is likewise novel, by first producing the inner and outer walls by thermoforming at from 150 to 300° C., in particular from 200 to 280° C., with preference from 200 to 260° C., and then combining these two parts with one another by welding, screwing or bolting, clipping, riveting or adhesive bonding. The inner and outer walls here may also be produced by injection molding or blow molding, for example.

The design of the novel inner container here embodies the principle of a shear-resistant double-walled design, giving a marked increase in flexural strength. For comparable external dimensions the resultant reduction in deflection is up to 60%.

The gain in stiffness thus obtained therefore permits the same material to be used to produce machinery with higher load-bearing capability or—if the loading is the same—permits the use of a less stiff material and therefore in practice mostly a less costly material.

The procedure for obtaining this shear-resistant double-wall design is to combine the inner and outer walls using frequently encountered combination techniques (welding, screwing, or bolting, riveting or, if desired, clipping) or by producing the part by blow molding.

It is expedient for the joint plane to be in the load-free neutral flexural zone of the system. For example, if the two parts are combined by heated tool welding the result is that the plane of welding is not subjected to load during use and therefore the risk of failure of the weld as a result of fracture can virtually be eliminated.

With comparable external dimensions of the inner container—and with mathematically optimized mass distribution—the resultant increase in stiffness could be utilized to improve the spin profile (rotation rate, unbalanced mass) of the machinery. A stiffer inner container wall also leads to lower deformation/inclination of the pulley due to the pulley pretension arising between pulley and motor.

A decisive factor in detailed design of the double-walled inner container is case-by-case wall-thickness optimization taking into account the loading to which the component is subject and the material to be used, for example using calculations from computer simulation.

An ideal design would take into account the available installation space and would proceed either via the wall thickness which is ideal for the production technology of the shaped article to arrive at the selection of the material best suited to give the inner container ideal strength, or would proceed via the lowest-cost material for the inner container to arrive at the wall thickness for ideal strength.

In this context particular attention needs to be given to that region of the wall of the inner container which is in direct proximity to the bearing. Inserts are often molded into this region, and into these are then introduced the ball bearings which serve as the bearings for the drum. These regions are sometimes very substantial (wall thickness up to 15 mm) for reasons of strength. However, these wall thicknesses are difficult to control in any process (cavitation) and moreover give very long cooling times and therefore increased costs due to prolonged manufacturing times. Since the novel inner container is composed of inner and outer walls, i.e. of a two-part wall, this region of the shaped article can also be optimized in injection molding, for example by replacing the accumulation of weight by two supporting structures, produced separately but connected for purposes of strength.

Another advantage of the novel inner container is that the space available between the back walls of the container can be used to accommodate the pulley often used currently, or to accommodate a direct drum drive. The space which results from this design method can be utilized to lengthen the inner drum and thus increase the volume of laundry.

The maximum achievable length of the inner drum is a function of the extent, required for reasons of strength, of the bearing region in the rear part of the container (tub) and of the manner of attachment of the pulley, taking into account the required distance of the vibrating system from the casing.

The dimensions currently required for the vibratory system are primarily determined by the bearing region, and thus by the bearing used and, respectively, by the hub molded into this region and having a height of from about 10 to 200 mm and defined by the distance between the two bearings. Added to this is the space, from about 10 to 100 mm, required for the pulley currently arranged between the holding vessel and the rear wall of the casing.

Since the novel inner container has a double wall, there is now the opportunity to place one bearing in each of the two individual walls in the rear part of the holding vessel (tub), and to install the pulley or the direct drive for the machine between the two walls/bearings.

A further advantage of the novel inner container is that the cavity between the inner and outer walls can also be filled with fillers of various types, allowing the property profile of the inner container to be modified. For example, by filling with rock flour or using a filling of another free-flowing material it is possible to integrate some of the compensating weights which hitherto have to be installed in a separate operation, and some or all of these weights can therefore be dispensed with. If the procedure is conceived as reversible, there is thus the opportunity of removing the weight for transport, thus markedly reducing the shipped weight and inertial mass, in turn reducing the loading on the transit securements in the event of any impact during shipping.

Using cured fillers, such as epoxy resins, can furthermore improve the stiffness of the inner container. Sound-deadening properties can also be increased by using molding compositions with damping properties, such as flexible polyurethane foams.

The double-walled structure of the novel inner container is particularly advantageous in the regions of the component where high strength is required, for example in those sides of tubs which have the bearings and/or in those sides of inner drums which have the axles.

The process for producing the inner container is also novel and is simple to carry out, and in particular can be carried out using customary assembly methods.

The novel inner container is suitable, inter alia, as an inner container for household devices, in particular for front- or top-loader washing machines and for laundry dryers, or else as a tub.

Some examples of embodiments of the novel inner container are described in more detail in the examples below.

EXAMPLE 1

The inner container for a top-loader washing machine is produced by orbital welding of an inner wall [1] and an outer wall [2] to give a shear-resistant connection. Both the inner and outer walls are composed of propylene homopolymer with a melt flow rate (MFR) to ISO 1133 of 7 g/10 min. at 230° C. with a load of 2.16 kg, reinforced with 30% by weight of talc.

The welding procedure is at the same time used to introduce the bearing [3] for the inner drum. The cavity of the part is then filled with a polymer concrete in order to increase the weight of the part and thus to replace some of the concrete compensating weight which has to be assembled subsequently.

FIG. 1 gives a diagram of this inner container for a top-loader washing machine.

EXAMPLE 2

The inner container for a front-loader washing machine is produced by heated-tool welding (hot-plate welding) an inner wall [1] and an outer wall [2] together to give a non-shear joint. Both the inner and outer walls are composed of propylene homopolymer with a melt flow rate (MFR) to ISO 1133 of 3 g/10 min. at 230° C. with a load of 2.16 kg, reinforced with 20% by weight of glass fibers.

A point for consideration in this context is the embedment, in the bearing region, of the bush [3], formed by the joining of the two parts and thus permitting the production of the molding with shapes (wall thicknesses) which are more advantageous in production. The cavity of the part is then filled with a polyurethane foam [4] in order to increase acoustic damping and slightly increase the strength of the part.

Figure 2:
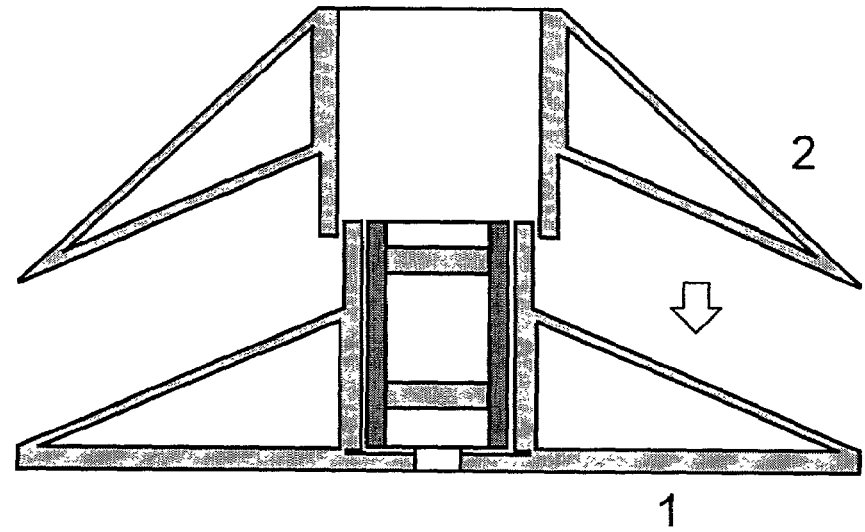
FIGS. 2 and 4 depict diagrams of an inner container for a front-loader washing machine.
Figure 2:
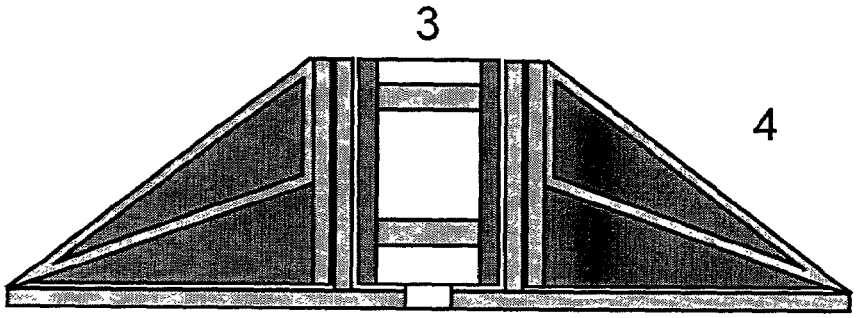
Figure 4:
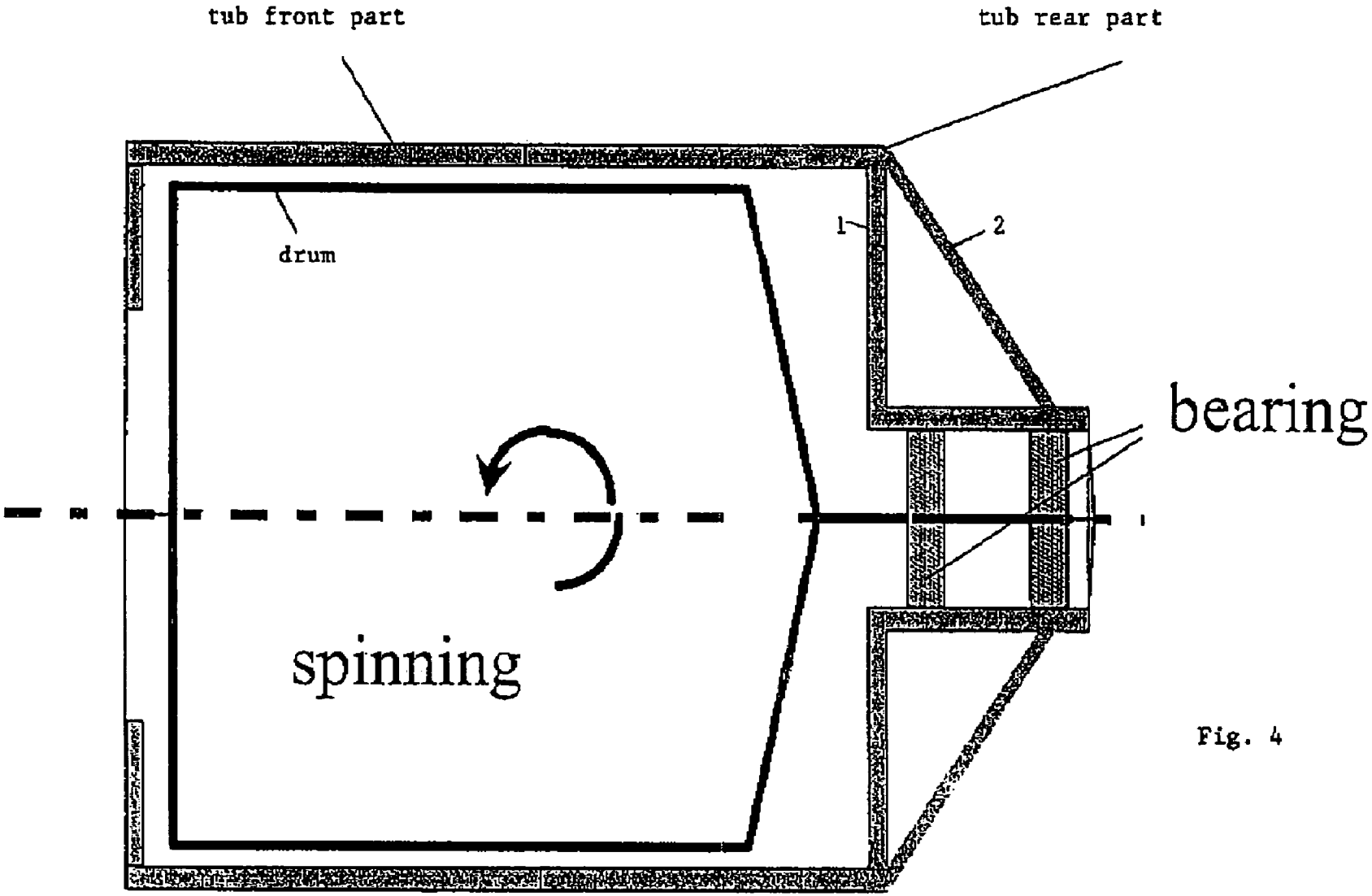

FIGS. 2 and 4 are diagrams of this inner container for a front-loader washing machine.

EXAMPLE 3

Figure 3:
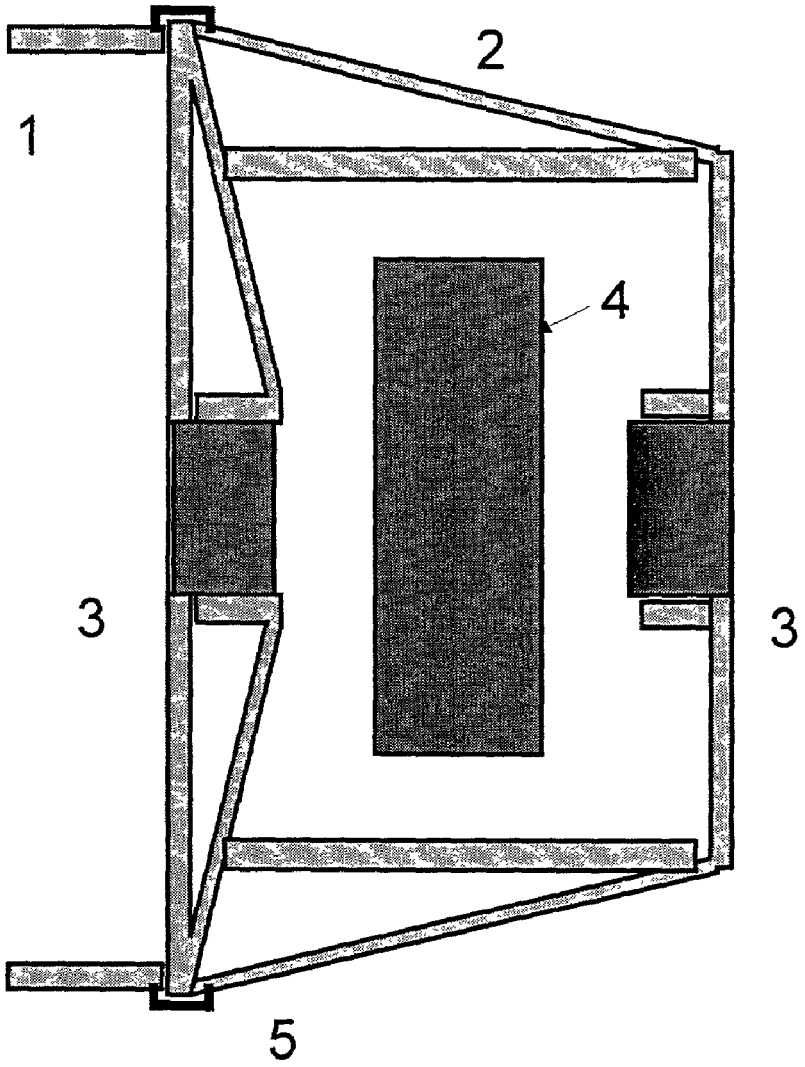
FIG. 3 depicts a diagram of an inner container for a front-loader washing machine with a direct drive.

FIG. 3 shows an inner container for a front-loader washing machine with a direct drive (without internal pulley) [4] between inner-wall bearing [3] and outer-wall bearing [3]. Both the inner [1] and outer [2] walls are composed of a propylene copolymer having 7.0% by weight of copolymerized ethylene and with a melt flow rate (MFR) to ISO 1133 of 3.0 g/10 min. at 230° C. with a load of 2.16 kg, reinforced with 40% by weight of glass fibers. The inner container described has the direct drive installed between the two bearings. The two wall sections are connected to one another by way of metal clamps [5] and supports, in a shear-resistant but separable manner, so that when a repair is needed the outer section of the container can be removed and there is access to the drive or the pulley wheel.

I claim:

1. An inner container for a household device, where said inner container is drum-shaped and has at least a portion which comprises an inner and an outer wall and a cavity situated between the inner and the outer wall with a shear resistant connection between the two walls, where both the inner and outer walls are made from a thermoplastic comprising polypropylene, wherein the inner wall has a thickness of from 2 to 5 mm, the outer wall has a thickness of from 2 to 5 mm, and wherein the cavity has a thickness of from 20 to 150 mm, and wherein the inner and the outer walls have applied to them a laminate made from a decorative layer and from a heat-cured layer situated on the decorative layer.

2. An inner container as defined in claim 1, where the cavity between the inner and outer walls is filled with a filler.

3. An inner container as defined in claim 1, where the cavity between the inner and outer walls is filled with concrete.

4. An inner container as defined in claim 1, where, between the thermoplastic of the inner and outer walls and the laminate, there is also an intermediate layer.

5. An inner container as defined in claim 1, where the thermoplastic also comprises reinforcing materials.

6. An inner container as defined in claim 1, wherein the household device is a front- or top-loading washing machine, or a laundry dryer.

7. An inner container as defined in claim 5, wherein the thermoplastic comprises from 5 to 50% by weight, based on the total weight of the thermoplastic, of reinforcing fillers.

8. A household device having a drum-shaped inner container, which device is selected from the group consisting of a front-loading washing machine, a top-loading washing machine and a laundry dryer, and wherein at least a portion of said inner container comprises an inner and an outer wall and a cavity situated between the inner and the outer wall with a shear resistant connection between the two walls, and both the inner and outer walls are made from a thermoplastic, wherein the inner wall has a thickness of from 2 to 5 mm, the outer wall has a thickness of from 2 to 5 mm, and wherein the cavity has a thickness of from 20 to 150 mm, and wherein the inner and the outer walls have applied to them a laminate made from a decorative layer and from a heat-cured layer situated on the decorative layer.

9. The household device defined in claim 8, wherein the cavity between the inner and outer walls is filled with a filler.

10. The household device defined in claim 8, wherein the thermoplastic comprises polypropylene.

11. The household device defined in claim 8, wherein, between the thermoplastic of the inner and outer walls and laminate, there is also an intermediate layer.

12. The household device defined in claim 8, wherein the thermoplastic comprises reinforcing materials.

13. The household device defined in claim 12, wherein the thermoplastic comprises from 5 to 50% by weight, based on the total weight of the thermoplastic, of reinforcing fillers.

14. An inner container for a household device, where said inner container is drum-shaped and has at least a portion which comprises an inner and an outer wall and a cavity situated between the inner and the outer wall with a shear resistant connection between the two walls, where both the inner and outer walls are made from a thermoplastic comprising polypropylene and where the cavity between the inner and outer walls is filled with a filler, and wherein the inner and the outer walls have applied to them a laminate made from a decorative layer and from a heat-cured layer situated on the decorative layer.

15. An inner container as defined in claim 14, where the filler is selected from the group of rock flour, concrete, talc, sand, liquids, gels and foamed plastics.

16. An inner container as defined in claim 14, where the thermoplastic also comprises reinforcing materials.

17. An inner container as defined in claim 16, wherein the thermoplastic comprises from 5 to 50% by weight, based on the total weight of the thermoplastic, of reinforcing fillers.

18. An inner container as defined in claim 14, wherein the household device is a front- or top-loading washing machine, or a laundry dryer.

* * * * *